US005971076A

United States Patent [19]

Taylor et al.

[11] Patent Number: 5,971,076

[45] Date of Patent: Oct. 26, 1999

[54] SUBSEA WELLHEAD STRUCTURE FOR TRANSFERRING LARGE EXTERNAL LOADS

[75] Inventors: William M. Taylor; Scott C. Stjernstrom, both of Houston, Tex.

[73] Assignee: Cooper Cameron Corporation, Hudson, Tex.

[21] Appl. No.: 08/920,996

[22] Filed: Aug. 29, 1997

[51] Int. Cl.[6] ..... E21B 7/12

[52] U.S. Cl. ..... 166/368; 285/320

[58] Field of Search ..... 166/368, 208, 166/89.1; 285/920, 315, 320

[56] References Cited

U.S. PATENT DOCUMENTS 4,169,507 10/1979 Szymczak .
4,408,784 10/1983 Reimert .
4,416,495 11/1983 Regan .
4,550,782 11/1985 Lawson .
4,693,497 9/1987 Pettus et al. .
4,817,992 4/1989 Yip et al. .
4,902,044 2/1990 Williams et al. ..... 285/18
4,976,458 12/1990 Hosie et al. .
5,029,647 7/1991 Milberger et al. .
5,066,048 11/1991 Farrell .
5,143,158 9/1992 Watkins et al. ..... 166/368

*Primary Examiner*—David Bagnell
*Assistant Examiner*—Zakiya Walker
*Attorney, Agent, or Firm*—Browning Bushman

[57] ABSTRACT

A wellhead structure having a subsea wellhead (10) connected to the lower end of a collet connector (30). A blowout preventer stack (8) is connected to the upper end of the collet connector (30) and a marine riser (13) is connected to the upper end of the blowout preventer stack (8). The wellhead (10) has an outer wellhead housing (12) fixed to the seabed (B) and an inner wellhead housing (14) supported within the outer wellhead housing (12). Upper hub (16) of outer wellhead housing (12) has an outer profile for mating in a releasably locked position with the collet connector (30). External tensile and bending loads are transmitted directly from the marine riser (13) and blowout preventer stack (8) to the outer wellhead housing (12) along load path L2 bypassing inner wellhead housing (14). One embodiment (FIGS. 5 and 6) shows an inner wellhead housing (14B) extending above the outer wellhead housing (12B) and adapted for separate connection to a small connector (30C) shown in FIG. 6 upon removal of the first connector (30B) from the outer wellhead housing (12B).

17 Claims, 4 Drawing Sheets

SUBSEA WELLHEAD STRUCTURE FOR TRANSFERRING LARGE EXTERNAL LOADS

FIELD OF THE INVENTION

This invention relates to a subsea wellhead structure having a wellhead secured to the sea floor, and more particularly to such a wellhead structure for transferring external loads from typically a blowout preventer stack and drilling riser to the wellhead through a wellhead connector.

BACKGROUND OF THE INVENTION

Heretofore, subsea wellheads have been provided in which an outer tubular wellhead housing is secured to the sea floor and an inner tubular wellhead housing is supported within the outer tubular wellhead housing. The inner wellhead housing has a hub projecting upwardly above the outer wellhead housing. A hydraulic wellhead connector forms a robust and disconnectable structural link from the drilling vessel's riser extending to the subsea wellhead below. A connector which may be connected at its upper end to a blowout preventer stack is latched on the hub of the wellhead inner housing. Thus, any external tension or bending loads are first transferred from the connector to the inner wellhead housing, and then transferred from the inner wellhead housing to the outer wellhead housing.

Such a wellhead structure is shown in U.S. Pat. No. 5,066,048 dated Nov. 19, 1991 in which the hub of an inner tubular wellhead housing extends upwardly above the outer tubular wellhead housing and has resilient fingers engaging the outer housing to effect preloading between the inner and outer wellhead housings. External tension and bending loads imparted at the connector to the inner wellhead housing interface are transferred to the outer wellhead housing through the inner housing.

The connector which connects to the hub of the inner housing is utilized in subsea drilling operations to connect a marine riser and blowout preventer stack to the wellhead. Subsea wells are being drilled at increased water depths over four thousand feet and some as deep as eight thousand feet. Particularly for "guidelineless" drilling from a drill ship or floating drilling platform, the drill ship or platform may be off location a substantial distance resulting from station keeping failures, tides, wind, water currents and the like. When the drill ship is off location, bending loads are generated through the interconnecting marine riser into the wellhead. Thus, the subsea wellhead and connector must be capable of withstanding the extreme bending loads resulting from the increased water depths at which this drilling is occurring. The connector provides a connection between the blowout preventer stack and the marine wellhead, and also affects a metal-to-metal seal at the wellhead. The connector should be designed to withstand any reasonable bending and separation forces caused by well pressure, riser tension, and bending loads created by motion from the drill ship or platform above.

U.S. Pat. No. 4,693,497 dated Sep. 15, 1987 shows a collet connector for connecting two axially aligned tubular members including latching fingers which engage outer shoulders on axially aligned tubular members for connecting the tubular members. When the collet connector is utilized for connecting a marine riser and blowout preventer stack to a subsea wellhead, the outer tubular member secured to the sea floor may, for example, be thirty six (36) inches or thirty (30) inches, in diameter while the inner tubular housing is about eighteen and three-fourths (18¾) inches in diameter.

All external bending and tension loads from the riser and blowout preventer (BOP) stack are transferred through the connector to the inner tubular housing through the interface between the inner tubular wellhead housing and the outer tubular wellhead housing, and eventually into the earth. The inner tubular housing also must be designed to withstand potentially high internal fluid pressure and the attending pressure end load imposed on the connector. The combined internal pressure and very high external loading resulting from deep water wells, which may be in water depths over five thousand (5,000) feet, may be as high as eight (8) million foot pounds.

It is an object of the present invention to provide a subsea wellhead system for deepwater drilling operations in which a subsea wellhead secured to the sea floor is capable of safely reacting large marine riser induced bending and tension loads.

It is a further object of this invention to provide such a wellhead system in which a connector for connecting the marine riser and blowout preventer stack to the wellhead is connected directly to the outer wellhead housing which is secured to the sea floor for transferring external tension and bending loads from the connector directly to the outer wellhead housing thereby bypassing the inner wellhead housing.

SUMMARY OF THE INVENTION

The present invention is directed to a subsea wellhead system in which a wellhead is mounted on the sea floor and is connected to a connector which supports a marine riser and blowout preventer (BOP) stack. The wellhead includes an outer housing secured to the sea floor and an inner housing supported in the outer housing. The inner and outer wellhead housings have enlarged diameter end hubs which have upper ends on which the connector is latched and supported. The hub of the outer housing has an outer profile including an outer annular groove and adjacent flange defining a pair of upwardly facing cam surfaces. The connector engages the pair of upwardly facing cam surfaces on the hub for securing the connector directly to the outer housing. All external tension and bending loads from the marine riser and BOP stack are transferred directly to the hub of the outer housing by the connecter thereby isolating the inner housing from these external loads. Thus, the inner wellhead housing is primarily exposed only to internal fluid pressure loading. The profile of the outer housing which is normally thirty (30) or thirty six (36) inches in diameter provides a high moment of inertia in bending and is easily designed to support the external tension and bending loads which may be as high as eight (8) to ten (10) million foot pounds.

The connector has an inner hub or body which is in axial alignment with the inner and outer tubular housings of the wellhead and the lower end surface of the connector body contacts the upper flush end surfaces of both wellhead housings. The connector is mounted on a shoulder of its body to permit pivoted rocking movement between engaged and disengaged positions of the cam surfaces on the hub of the outer tubular housing. The hub profile of the outer tubular housing is particularly designed for mating with the connector to produce a preload condition for tightly clamping the hub of the outer housing to the body of the connector. The hub profile of a thirty six (36) inch diameter outer housing is particularly suited for the high preloads required for the external tension and bending loads transferred from the marine riser and blowout preventer primarily due to its large diameter as compared to the inner housing.

Other features and advantages of the invention will be apparent from the following specification and drawings.

DESCRIPTION OF THE PRIOR ART

Figure 1:
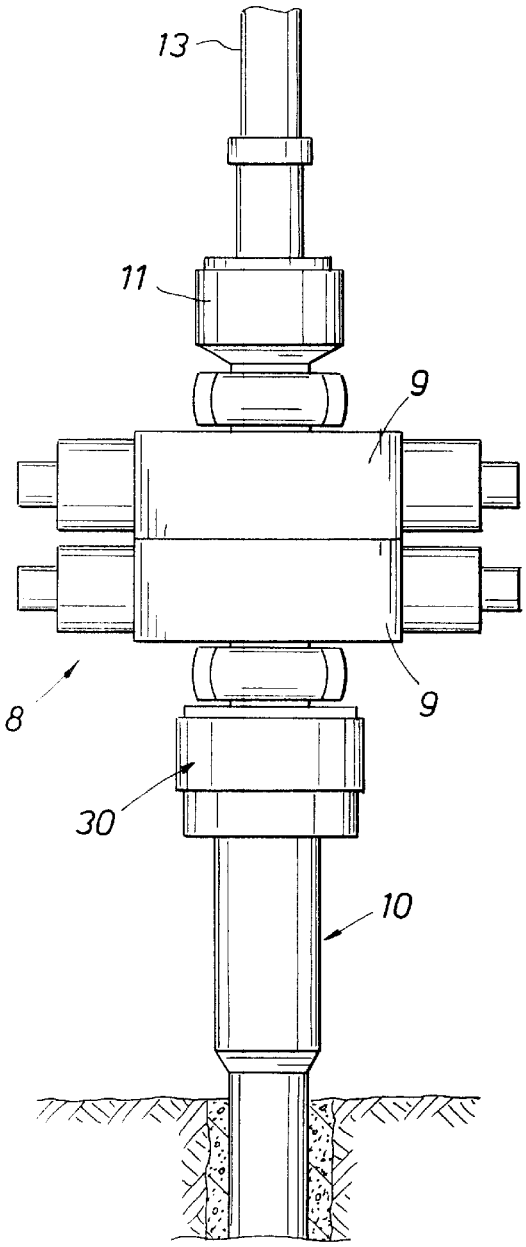
FIG. 1 is an elevational view, partly schematic, of the present invention showing a subsea wellhead structure having a blowout preventer and a connector latched to the outer wellhead housing therefore transmitting the combined external tension and bending loads directly from the marine riser and blowout preventer to the outer wellhead housing for bypassing the inner wellhead housing.
Figure 2:
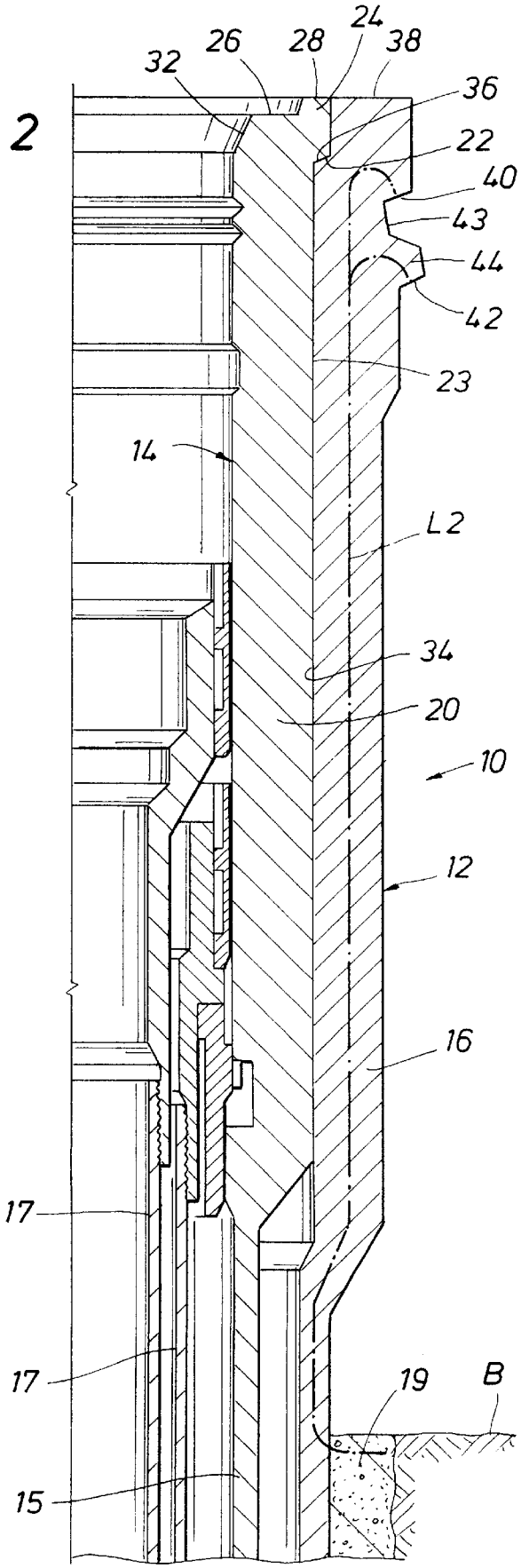
FIG. 2 is an enlarged sectional view of the inner and outer tubular members of the subsea wellhead having flush upper end surfaces for contacting the connector.
Figure 1A:
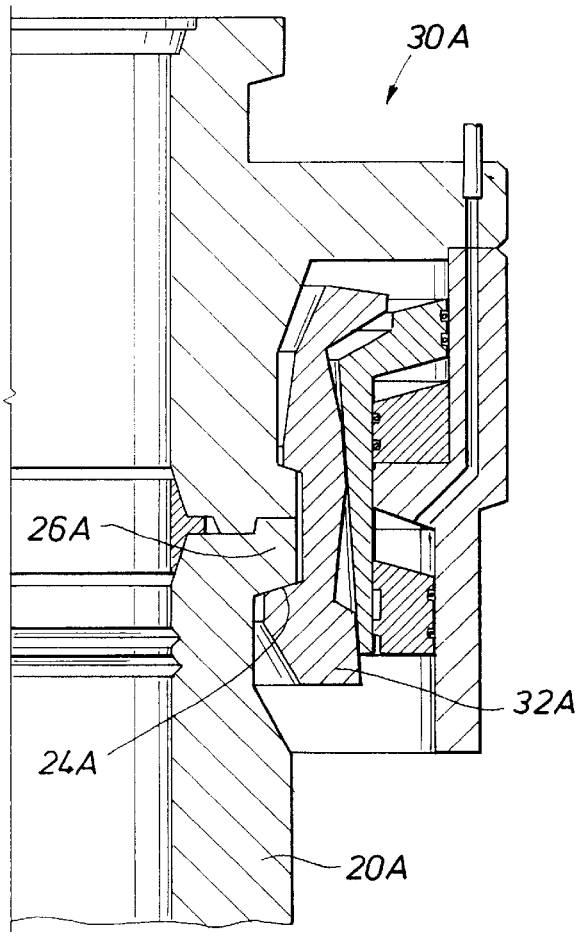
FIG. 1A (PRIOR ART)
FIG. 1A is a sectional view of a traditional collet style wellhead connector latched to the upper hub of an inner wellhead housing of a prior art subsea wellhead structure.
Figure 1B:
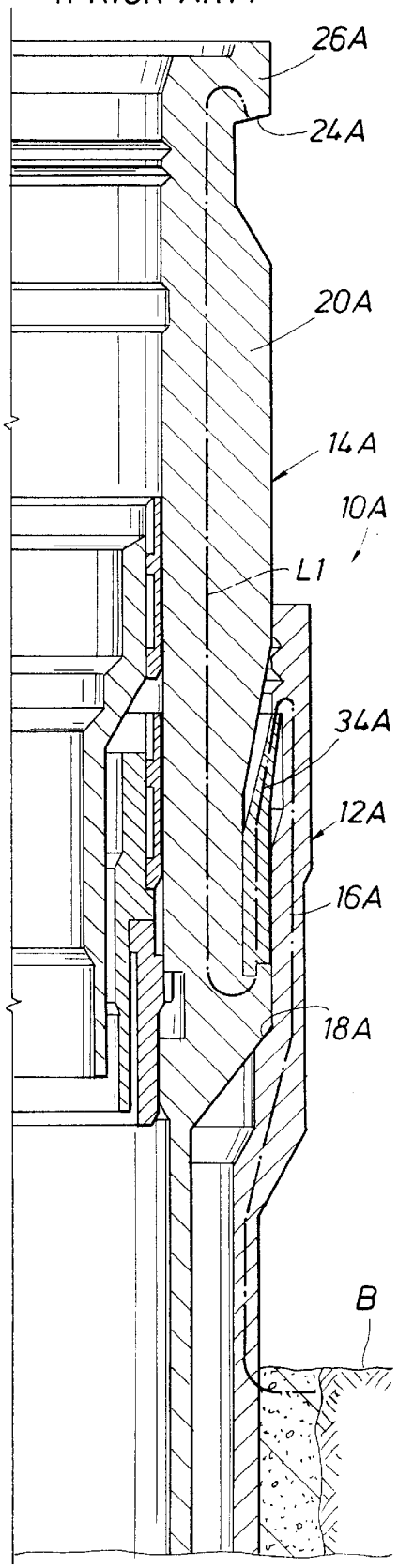
FIG. 1B (PRIOR ART)
FIG. 1B is a sectional view of the prior art inner wellhead housing of FIG. 1 shown with the connector disconnected and supported within the outer wellhead housing.

Referring to the drawings for a better understanding of this invention, and more particularly to FIGS. 1A and 1B, a prior art collet connector is shown connected to the upper end of an inner tubular member of a prior art subsea well in FIG. 1A, and the inner tubular member with the collet connector removed is shown in FIG. 1B supported within the outer tubular member. A subsea wellhead generally indicated at 10A has an outer tubular housing 12A fixed to the seabed B and an inner tubular housing 14A is received within outer tubular housing 12A. Outer housing 12A has an upper housing section 16A with an inner landing shoulder 18A. Inner wellhead housing 14A has an upper housing section 20A seated on shoulder 18A and extending upwardly above outer wellhead housing 12A. Housing section 20A has an outer groove 24A and an associated hub 26A for mating with a collet connector generally indicated at 30A having locking latches or fingers 32A for mating with groove 24A and hub 26A. Thus, external tension and bending loads from collet connector 30A are transferred directly to inner wellhead housing 14A. Inner wellhead housing 14A has outer resilient fingers 34A for transferring external loads to outer wellhead housing 12A as illustrated by the load path defined by line L1. Reference is made to U.S. Pat. No. 5,066,048 dated Nov. 19, 1991 for further details of wellhead 10A and the entire disclosure of U.S. Pat. No. 5,066,048 is incorporated herein for all purposes.

DESCRIPTION OF THE PRESENT INVENTION

Embodiment of FIGS. 1–4

Referring now to FIGS. 1–4 in which the present invention is illustrated, a subsea wellhead structure includes a subsea wellhead generally indicated at 10, a collet connector generally indicated at 30, and a blowout preventer (BOP) stack generally indicated at 8. BOP stack 8 has a pair of blowout preventers 9 connected to the upper end of collet connector 30. A flex joint 11 at the upper end of BOP stack 8 is connected to the lower end of a marine riser 13 extending to a drill ship or drilling platform on the sea surface. The riser 13 and BOP stack 8 exert a bending load on wellhead 10 particularly when the drill ship is off location. At water depths of eight thousand (8,000) feet, for example, the drill ship may be a substantial distance off location which would result in increased bending and tension loads exerted on the subsea wellhead 10.

Subsea wellhead 10 has an outer tubular housing 12 fixed to seabed B by an outer cement liner 19 for example. An inner tubular wellhead housing 14 is received within outer wellhead housing 12. Inner wellhead housing 14 has an upper housing section 20 connected to a lower casing string 15. Additional casing strings 17 are supported from housing section 20. An outer shoulder 22 is provided about the outer periphery 23 of housing section 20. The upper end of housing section 20 has a hub 24 adjacent an upper annular recess 26. Hub 24 forms an upper planar surface 28. An inner inclined or tapered surface 32 is provided adjacent recess 26.

Outer wellhead housing 12 has an upper housing section 16 defining an inner peripheral surface 34 in contact relation with outer peripheral surface 23 of housing section 20 and an inner landing shoulder 36 in supporting mating relation with outer shoulder 22 on upper housing section 20. The upper end of housing 12 has an upper outer hub defining a planar surface 38 flush with planar surface 28 to form a smooth continuation thereof. The outer periphery or profile of housing section 16 has a pair of downwardly facing inclined cam surfaces 40 and 42 adjacent groove 43 and annular protuberance or flange 44.

Figure 4:
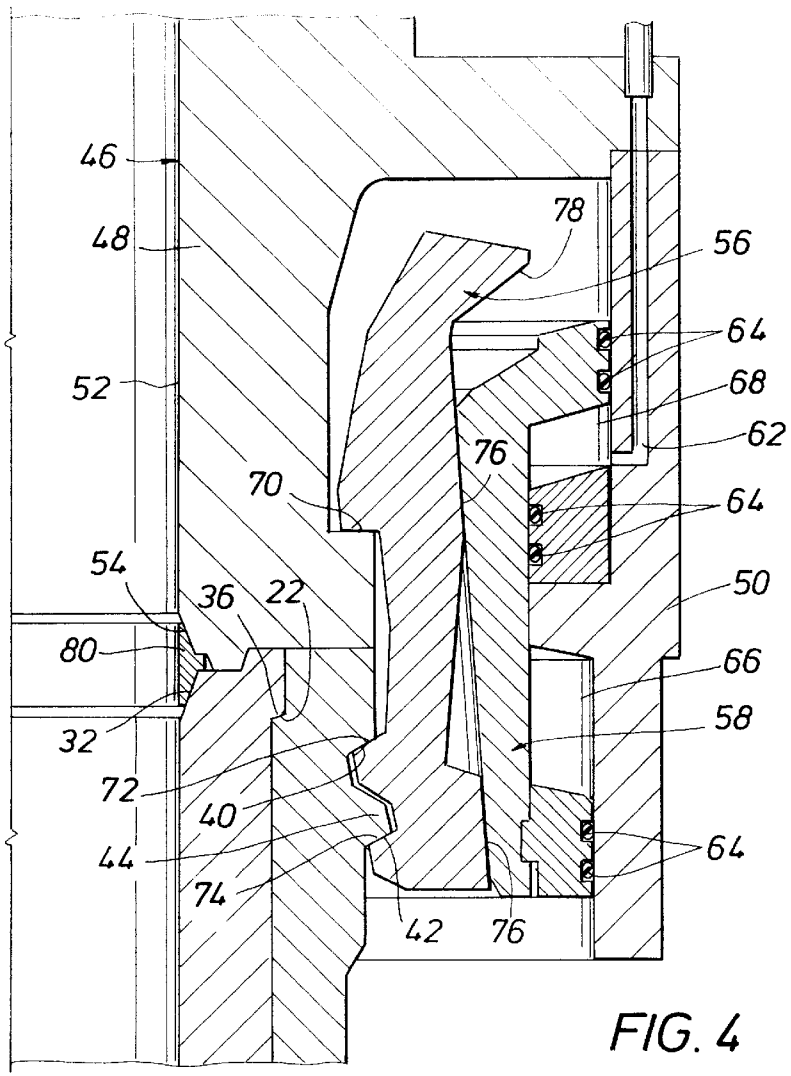
FIG. 4 is an enlarged sectional view similar to FIG. 3 but showing the locking members in locked position.
Figure 3:
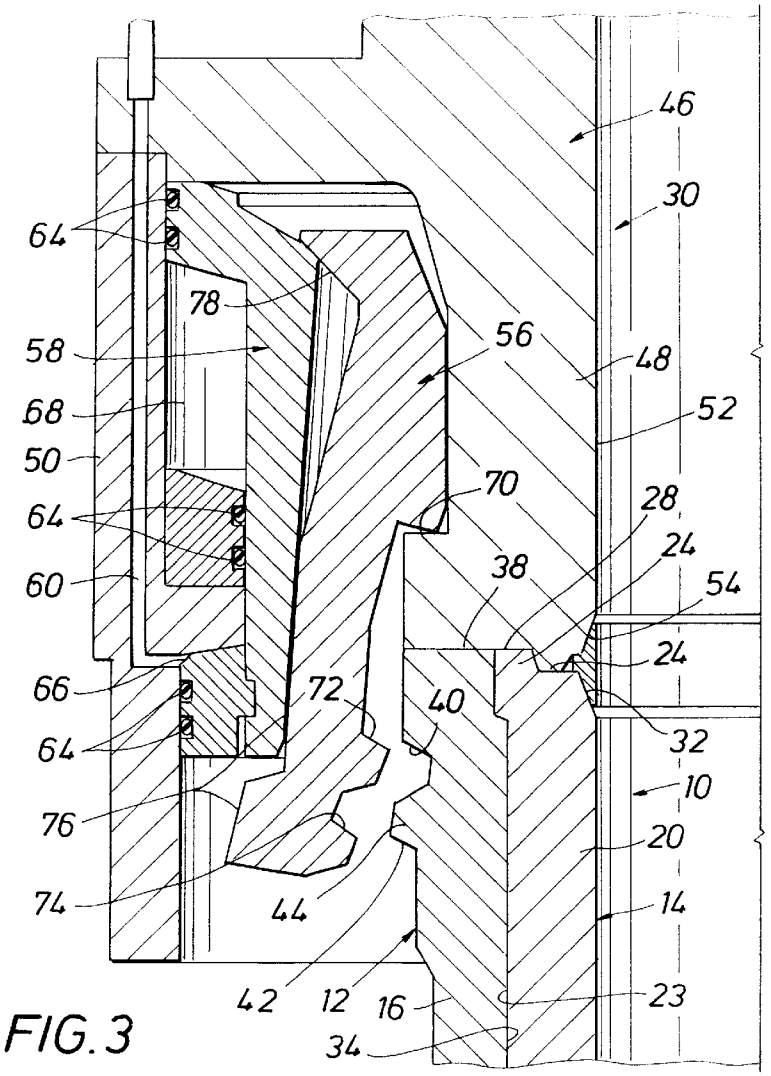
FIG. 3 is an enlarged sectional view of the connector positioned on the tubular members with locking members released from the outer tubular member.

Collet connector 30 is designed to fit over inner wellhead housing 14 and outer wellhead housing 12 and to engage cam surfaces 40 and 42 on the outer housing 12 in mating relation for transferring external loads from riser 13 and BOP stack 8 directly to outer wellhead housing 12 along load line L2 while bypassing inner wellhead housing 14. Thus, inner wellhead housing 14 is isolated from external tension and bending loads. Collet connector 30 has a body 46 defining an inner hub 48 and an outer generally cylindrical wall 50. Hub 48 has an inner bore 52 and a tapered lower end 54. An annular space is formed between outer wall 50 and inner hub 48. Mounted in the annular space are a plurality of latch members or fingers 56 spaced about a circle and defining locking members. A hydraulically actuated annular piston is generally indicated at 58 adjacent latch members 56. Piston 58 is double acting with hydraulic fluid supplied to fluid chamber 66 through fluid passage 60 to move piston 58 downwardly to an engaged position as shown in FIG. 4. Fluid is supplied through passage 62 to fluid chamber 68 to move piston 58 upwardly to a disengaged position as shown in FIG. 3. Suitable seals 64 seal fluid chambers 66 and 68 against fluid leakage.

Hub 48 has an outer peripheral shoulder 70 and latch fingers 56 are mounted thereon for pivotal rocking movement between disengaged position with downwardly facing cam surfaces 40 and 42 as shown in FIG. 3 and engaged mating position with downwardly facing surfaces 40 and 42 as shown in FIG. 4. Latch fingers 56 have upwardly facing engaging surfaces 72 and 74 thereon for engaging respective cam surfaces 40 and 42. Lower inclined surfaces 76 on latch fingers 56 are engaged by annular piston 58 to rock latching fingers 56 into engaged position with cam surfaces 40 and 42 on outer wellhead housing 12 as shown in FIG. 4. Upper inclined surfaces 78 on latch fingers 56 are engaged by annular piston 58 as shown in FIG. 3 to rock or pivot latch fingers 56 out of engaged position with cam surfaces 40 and 42 on outer wellhead housing 12.

A metal gasket 80 is mounted on tapered surfaces 32 and 54 of lower hub 20 on inner wellhead housing 14 and inner hub 48 on collect connector 30 for sealing between collet connector 30 and inner wellhead housing 14. Reference is made to U.S. Pat. No. 4,693,497 dated Sep. 15, 1987 illustrating a collet connector which has been found to be satisfactory for the present invention. The entire disclosure of U.S. Pat. No. 4,693,497 is incorporated by this reference for all purposes.

Figure 6:
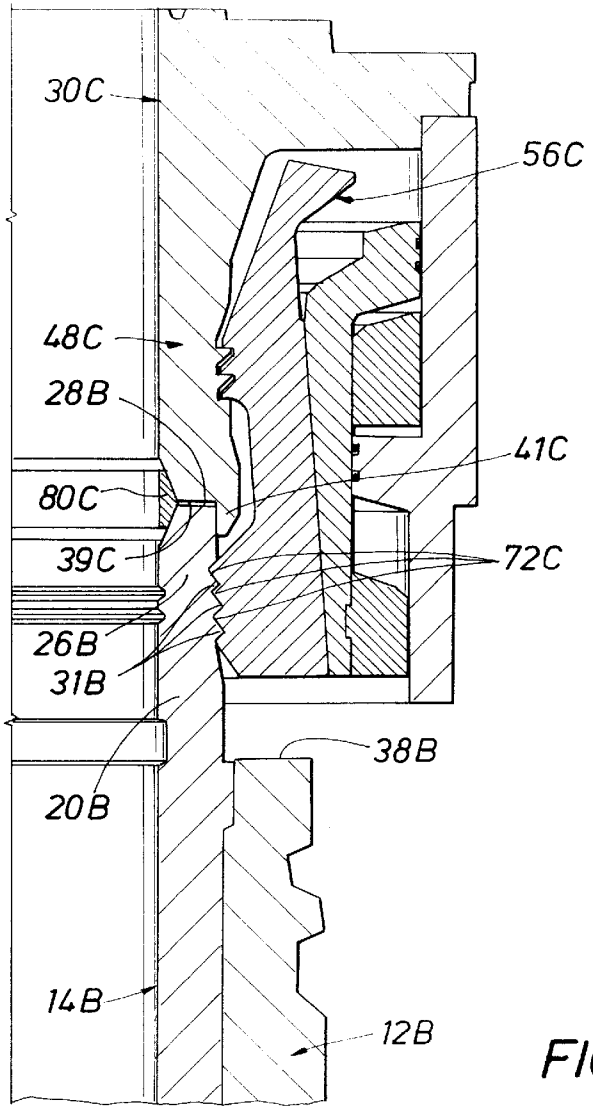
FIG. 6 is an enlarged sectional view of the embodiment of FIG. 5 with the connector for the outer housing removed and illustrating another small connector latched to the inner housing.
Figure 5:
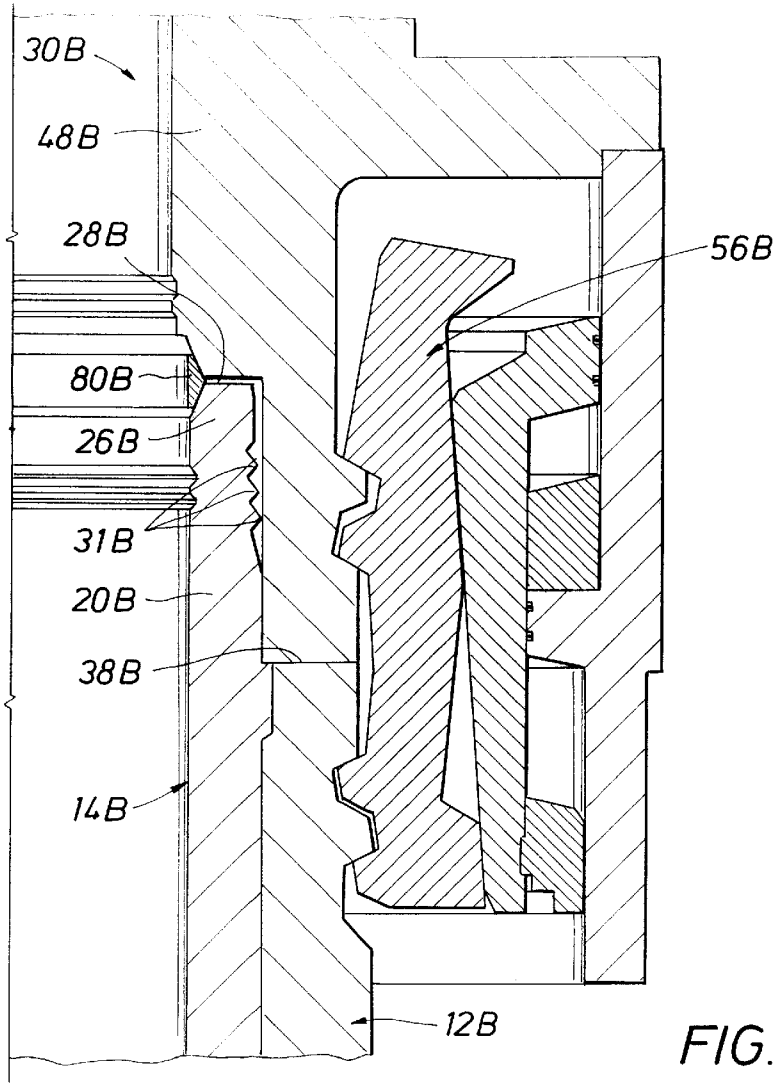
FIG. 5 is an enlarged sectional view of another embodiment of this invention in which the inner housing extends above the outer housing with the connector latched to the outer housing.

Embodiment of FIGS. 5 and 6

Referring now to FIG. 5 and 6, a separate embodiment of the invention is illustrated in which inner wellhead housing 14B has an upper housing section 20B with a hub 26B thereon. Hub 26B projects upwardly beyond upper planar end 38B of outer wellhead housing 12B and has an upper planar end 28B. A collet connector 30B similar to collet connector 30 of the embodiment shown in FIGS. 1–4 is shown in FIG. 5 and has a hub 48B spaced from end 28B but in abutting contact with end surface 38B of outer housing 12B. Connector 30B has latch members 56B operable as latch members 56 in the embodiment shown in FIGS. 3 and 4. Metal gasket 80B extends between sealing surfaces on hub 48B and inner wellhead housing 14B. Loads from collet connector 30B are transferred to outer housing 12B through upper planar surface 38B thereby bypassing inner housing 14B.

Inner housing 14B upon removal of connector 30B from outer housing 12B is adapted for connection to another connector as shown in FIG. 6 as may be desirable for certain operations, such as workover operations, for example. For that purpose hub 26B is provided with outer annular projections or ridges 31B forming inclined engaged surfaces for connector 30C as shown in FIG. 6. Connector 30C has a hub 48C and latch members 56C. Latch members 56C have projections 72C defining engaging surfaces for engaging projections 31B in latched relation as shown in FIG. 6. A metal-to-metal gasket 80C is shown between sealing surfaces on hub 48C and inner wellhead housing 14B. Hub 48C has a lower end surface 39C in abutting contact with end 28B of inner housing 14B and an outer annular lip 41C extends downwardly alongside hub 26B of inner wellhead housing 14B.

In some instances, it may be desirable to have the upper surface of inner housing 14 or 14B below the upper surface of outer housing 12 or 12B. The present invention will function in a satisfactory manner with such modification.

From the above, it is apparent that the present invention utilizes a subsea wellhead having an outer housing secured to the sea floor and an inner wellhead housing received within the outer wellhead housing with the outer housing having an outer profile for connecting to an upper connector. The connector has a marine riser and blowout preventer (BOP) stack thereon so that external tensile and bending loads from the riser and BOP stack are transmitted directly to the hub of the outer wellhead housing thereby bypassing the inner wellhead housing. Such a subsea wellhead is particularly desirable at increased water depths or eight or ten thousand (8,000 or 10,000) feet, for example. The drilling of wells at such increased depths creates substantially increased external bending and tension loads as a result of the drill ship or drilling platform being off location a substantial distance.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A subsea wellhead structure comprising:

a connector having a latching element mounted for movement in a lateral direction;

an outer wellhead housing secured to the sea floor beneath said connector having an upper hub of increased thickness and an inner annular landing shoulder;

an inner wellhead housing seated on said annular landing shoulder having an upper hub of increased thickness; said outer wellhead housing having a height generally similar to a height of said inner wellhead housing and in peripheral contact with said inner wellhead housing throughout substantially an entire length of said inner wellhead housing;

said upper hub on said outer housing having an outer profile including a downwardly facing cam surface;

said latching element on said connector mounted for movement in a lateral direction inwardly to contact and engage said cam surface for releasably securing said connector to said outer housing for transferring external tension and bending loads directly therebetween.

2. A subsea wellhead structure as set forth in claim 1 wherein:

said latching element has a pair of spaced upwardly facing engaging surfaces and said upper hub of said outer wellhead housing has a pair of downwardly facing cam surfaces, said downwardly facing cam surfaces on said upper hub of said outer wellhead housing being engaged by and cammed upwardly by said upwardly facing engaging surfaces upon engagement of said latching element with said downwardly facing cam surfaces.

3. A subsea wellhead structure as set forth in claim 2 wherein:

said latching element is mounted for rocking inwardly into engaged position with said cam surfaces and for rocking outwardly from engaged position to a disengaged position with said cam surfaces.

4. A subsea wellhead structure as set forth in claim 1 wherein said upper hub of said outer wellhead housing and said inner housing have planar upper end surfaces essentially flush with each.

5. A subsea wellhead system comprising:

a blowout preventer stack having an upper end and a lower end;

a connector extending below and connected to the lower end of said blowout preventer stack and having a plurality of latching elements mounted for movement in a lateral direction; and a wellhead extending below and connected to the connector having an outer wellhead housing and an inner wellhead housing; said outer wellhead housing secured to the sea floor beneath said connector having an upper hub of increased thickness and an inner annular landing shoulder; said inner wellhead housing seated on said annular landing shoulder and having an upper hub of increased thickness;

said hub on said outer housing having an outer profile including a downwardly facing cam surface;

said latching elements on said connector mounted for movement in a lateral direction inwardly to contact and engage said cam surface for releasably securing said connector to said outer housing for transferring tension and bending loads therebetween.

6. A subsea wellhead system as set forth in claim 5 wherein said hubs have planar upper end surfaces flush with each; and said connector is seated on said planar upper end surfaces.

7. A subsea wellhead system as set forth in claim 6 wherein:

said connector has an upper hub in axial alignment with said hubs on said inner and outer wellhead housings and seated on said flush upper end surfaces;

an inner peripheral recess is formed between said hubs on said connector and said inner wellhead housing; and a gasket is mounted in said recess for sealing between said hubs on said connector and said inner housing.

8. A subsea wellhead system as set forth in claim 7 wherein:

said upper hub of said connector has an outer peripheral shoulder; and said latching elements are mounted on said shoulder for pivoting rocking movement between engaged and disengaged positions with said outer wellhead housing.

9. A subsea wellhead system as set forth in claim 5 wherein:

said latching elements have a pair of spaced upwardly facing engaging surfaces and said hub on said outer wellhead housing has a pair of downwardly facing cam surfaces, said downwardly facing cam surfaces on said hub of said outer housing being engaged by and cammed upwardly by said upwardly facing engaging surfaces upon engagement of said latching elements with said downwardly facing cam surfaces.

10. A subsea wellhead system as set forth in claim 9 wherein:

said latching elements are mounted for rocking inwardly into engaged position with said cam surfaces and for rocking outwardly from engaged position to a disengaged position with said cam surfaces.

11. A subsea wellhead system as set forth in claim 5 further including a marine riser connected to the upper end of said blowout preventer stack.

12. A subsea wellhead system comprising:

a blowout preventer stack having a lower end and an upper end;

a marine riser connected to the upper end of said blowout preventer stack;

a connector connected to the lower end of said blowout preventer stack and having a plurality of latching elements mounted for movement in a lateral direction; and a wellhead connected to said connector having an outer wellhead housing and an inner wellhead housing; said outer wellhead housing secured to the sea floor beneath said connector having an upper end hub of increased thickness and an inner annular landing shoulder; said inner wellhead housing seated on said annular landing shoulder and having an upper hub projecting upwardly above said upper end hub of said outer wellhead housing;

said hub on said outer housing having an outer profile including a downwardly facing cam surface;

said latching elements on said connector mounted for movement in a lateral direction inwardly to contact and engage said cam surface for releasably securing said connector to said outer housing for transferring tension and bending loads therebetween;

said upper hub on said inner housing having an outer profile located above said outer housing including annular elements for subsequent connection to a separate connector positioned above said upper end hub of said outer wellhead housing upon removal of said first mentioned connector.

13. A subsea wellhead system as set forth in claim 12 wherein said annular elements include cam surfaces for engagement by said separate connector.

14. A subsea wellhead structure comprising:

a connector having a latching element mounted for movement in a lateral direction;

an outer wellhead housing secured to the sea floor beneath said connector having an upper hub of increased thickness and an inner annular landing shoulder;

an inner wellhead housing seated on said annular landing shoulder having an upper hub of increased thickness;

said upper hub on said outer housing having an outer profile including a downwardly facing cam surface;

said connector having a body defining an inner hub and an outer cylindrical wall with an open annular space therebetween; and said latching element on said connector mounted for movement in a lateral direction inwardly to contact and engage said cam surface for releasably securing said connector to said outer housing for transferring external tension and bending loads directly therebetween, said latching element being mounted on said inner hub for rocking inwardly into engaged position with said cam surface and for rocking outwardly from said engaged position to a disengaged position with said cam surface.

15. A subsea wellhead structure as set forth in claim 14 wherein:

a fluid actuated double acting annular piston engages said latching element to cam said latching element inwardly into engaged position with said cam surface upon fluid actuation of said piston in a downward direction, said annular piston engaging said latching element to cam said latching element outwardly into a disengaged position with said cam surface upon fluid actuation of said piston in an upward direction.

16. A subsea wellhead structure comprising:

a connector having a latching element mounted for movement in a generally radial direction;

an outer wellhead housing secured to the sea floor beneath said connector having an upper hub of increased thickness and an inner annular landing shoulder;

an inner wellhead housing seated on said annular landing shoulder having an upper hub of increased thickness;

said upper hub on said outer housing having an outer profile including a downwardly facing cam surface, said upper hub and said inner wellhead housing having planar upper end surfaces essentially flush with each other;

said latching element on said connector mounted for movement in a lateral direction inwardly to contact and engage said cam surface for releasably securing said connector to said outer housing for transferring external tension and bending loads directly therebetween, said connector having an upper hub in axial alignment with said hubs on said inner and outer housings and seated thereon;

an inner peripheral recess formed between said hubs on said connector and said inner housing; and a gasket mounted in said recess for sealing between said hubs on said connector and said inner housing.

17. A subsea wellhead structure as set forth in claim 16 wherein:

said upper hub of said connector has an outer peripheral shoulder; and said latching element is mounted on said shoulder for pivoting rocking movement between engaged and disengaged positions with said outer wellhead housing.

* * * * *